US005996969A

United States Patent [19]

Johnston et al.

[11] Patent Number: 5,996,969

[45] Date of Patent: Dec. 7, 1999

[54] STAPLE REMOVAL TOOL

[76] Inventors: Daniel S. Johnston, 5850 Wallace Rd., NW., Salem, Oreg. 97304; Michael A. Quesada, 985 Seventh St., P.O. Box 1019, Aumsville, Oreg. 97325

[21] Appl. No.: 09/062,245

[22] Filed: Apr. 17, 1998

[51] Int. Cl.[6] ..... B25C 11/00

[52] U.S. Cl. ..... 254/28

[58] Field of Search ..... 254/28; 227/63

[56] References Cited

U.S. PATENT DOCUMENTS

| | | | |
|---|---|---|---|
| 722,975 | 3/1903 | Haley | 254/28 |
| 1,989,918 | 2/1935 | Drypolcher | 254/28 |
| 2,544,492 | 3/1951 | Downing | 254/28 |
| 4,026,520 | 5/1977 | Rothfuss et al. | 254/28 |
| 5,524,866 | 6/1996 | Taylor | 254/28 |

*Primary Examiner*—Robert C. Watson
*Attorney, Agent, or Firm*—Olson & Olson

[57] ABSTRACT

A staple removal tool includes an elongated handle mounting a U-shaped cover member supporting a U-shaped base member formed with a forwardly projecting staple lifter tongue. A crimping arm is pivoted on the base member for movement toward and away from the staple lifter tongue and is actuated by a hand lever located under the handle and pivotally secured at its forward end to the cover member. A spring loaded link member is attached at one end to the hand lever and at the opposite end to the crimping arm, whereby pivoting of the handle lever effects pivotal movement of the crimping arm. A crimping bar is secured to and spaced from the base member to receive the clamping arm between them. The staple lifter tongue engages under the bridge portion of a staple, such as a roofing staple, and leveraging of the handle pulls the staple from its wood anchor. If the staple breaks, or if only one leg pulls out of the wood, the upwardly projecting length of staples still anchored in wood is placed alongside the confronting sides of the tongue and crimping bar and the hand lever manipulated to pivot the clamping arm into the space between the tongue and crimping bar, whereby to bend the staple leg to U-shape around the clamping arm and secure it against release, allowing the handle to leverage the resistant leg out of the wood.

6 Claims, 4 Drawing Sheets

STAPLE REMOVAL TOOL

BACKGROUND OF THE INVENTION

This invention relates to staple pullers, and more particularly to a tool for removing roofing and other construction type staples.

Roofing materials often are secured to roofs by staples of diverse widths and lengths and of relatively large gauge wire. When replacement of the roofing material is required, the existing material is removed by tools designed for the purpose. However, many random pieces of roofing material and staples remain attached to the roof.

Various tools have been devised heretofore for removing staples from wood and other materials. Exemplary of these are disclosed in U.S. Pat. Nos. 5,088,692 and 4,293,119. These and all other known tools are incapable of extracting those staples which have been broken or which leaves one of the staple legs retained in the wood while the other leg has been extracted.

SUMMARY OF THE INVENTION

This invention provides a staple removal tool which includes clamping mechanism that secures one leg of a staple positively to the tool, to insure extraction of that leg from the wood or other structure.

It is the principal objective of this invention to provide a staple removal tool that is capable of securing a staple releasably to it, to achieve extraction.

Another objective of this invention is the provision of a staple removal tool of the class described which functions to form a U-shaped bend in a staple leg to effect positive attachment to the tool for extraction.

Still another objective of this invention is the provision of a tool of the class described that is usable with a wide variety of sizes of staples.

A further objective of this invention is to provide a staple removal tool of the class described that is of simplified construction for economical manufacture, maintenance and repair.

The foregoing and other objects and advantages of this invention will appear from the following detailed description, taken in connection with the accompanying drawings of a preferred embodiment.

DESCRIPTION OF THE PREFERRED EMBODIMENT

Figure 1:
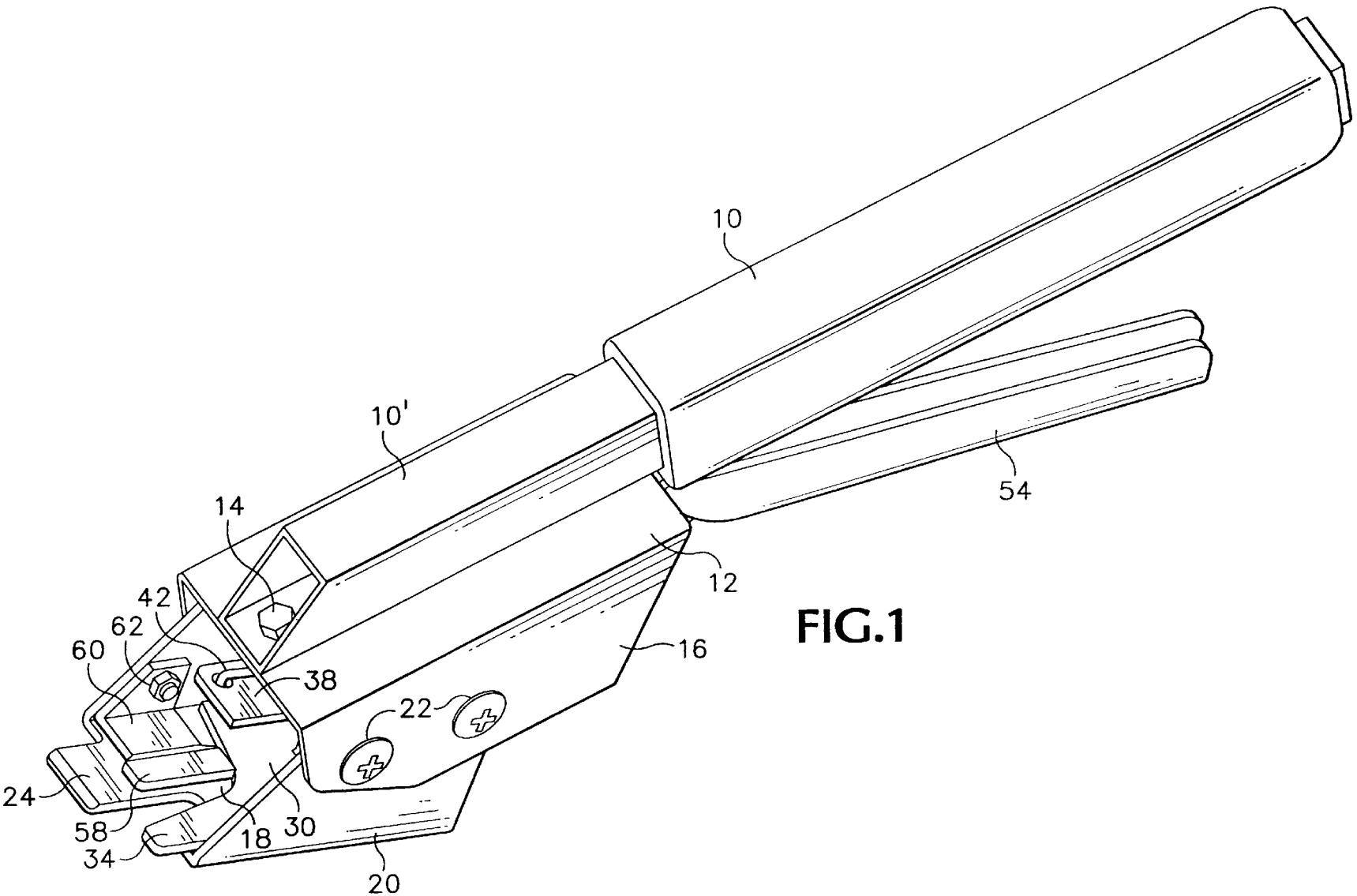
FIG. 1 is a perspective view of a staple removal tool embodying the features of this invention.
Figure 2:
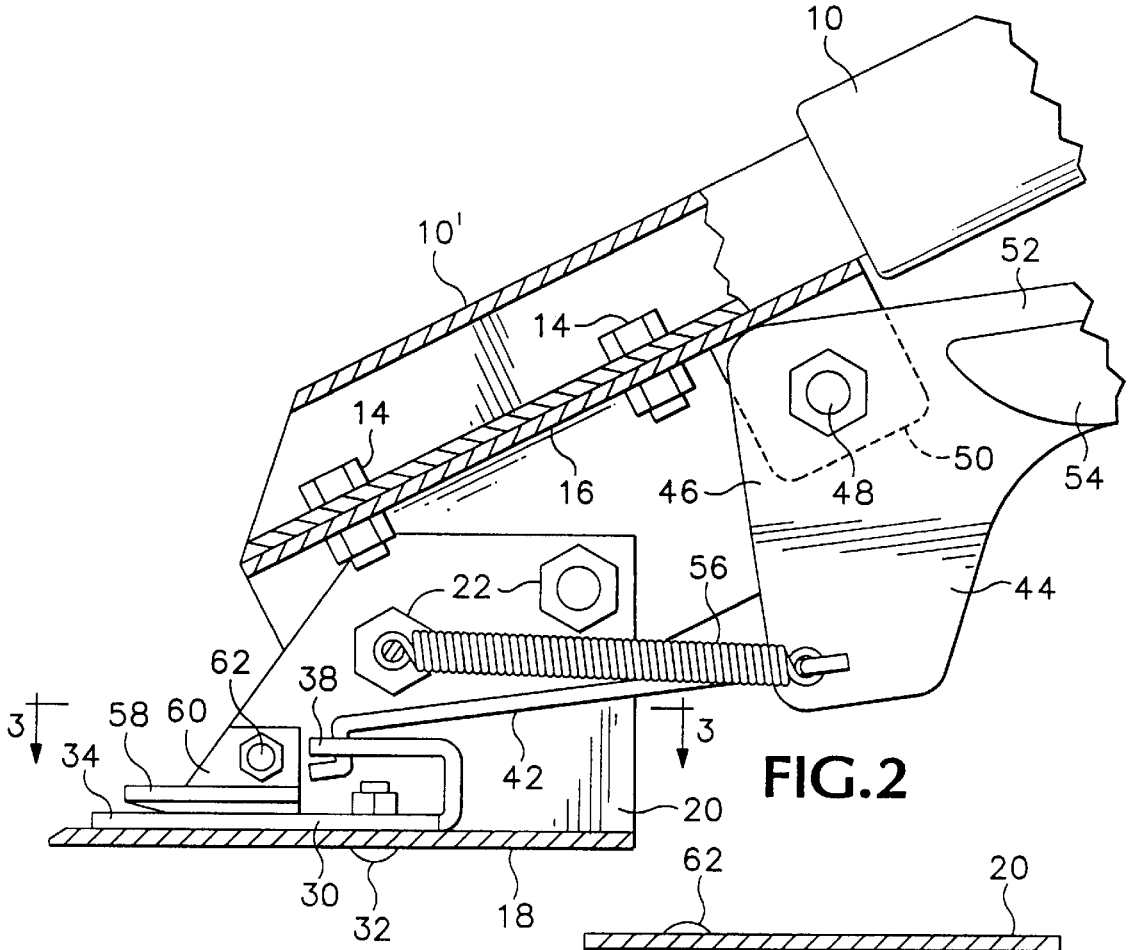
FIG. 2 is a fragmentary longitudinal sectional view, on an enlarged scale, of the head end of the tool of FIG. 1, showing the structural arrangement of components.

FIG. 1 illustrates a preferred embodiment of the staple removal tool of this invention. It includes an elongated handle having a rearward hand grip portion 10 and a forward head mounting portion 10'. The forward portion mounts a U-shaped cover member 12, as by bolts 14. The cover member has laterally spaced, downwardly extending flanges 16.

Figure 6:
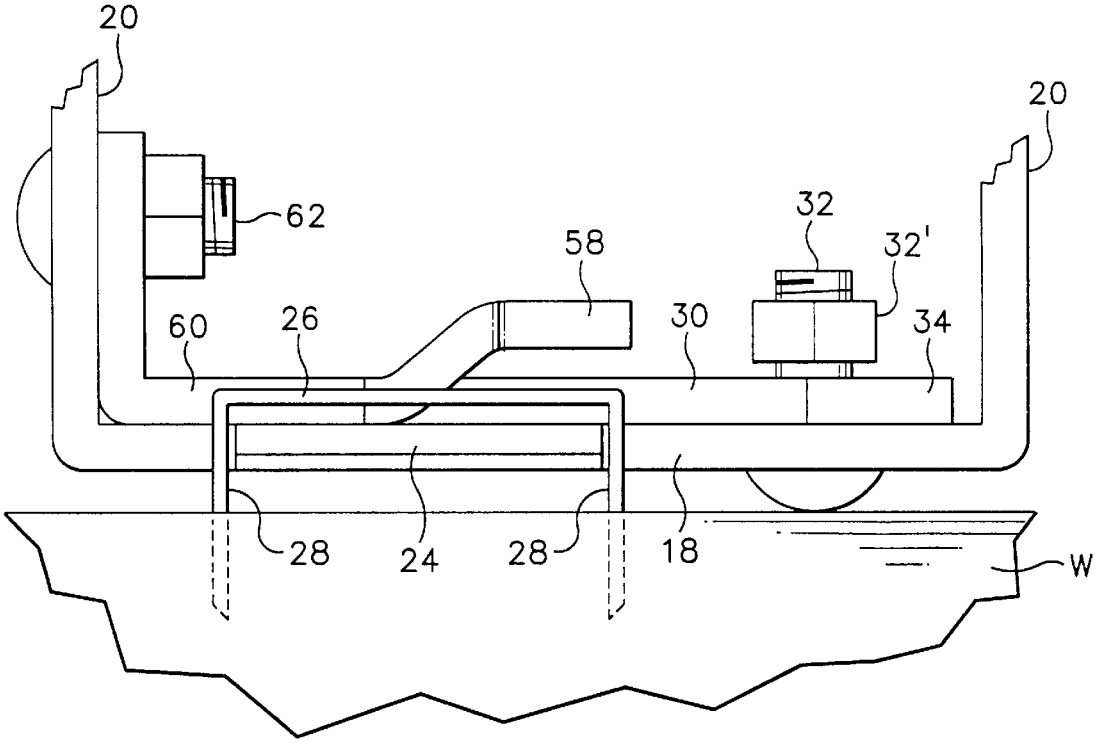
FIG. 6 is a fragmentary diagrammatic front elevation of the tool of FIG. 5 showing the tool in operative position with a staple in partially extracted position and with the clamping arm retracted.

A base member 18 also is of U-shape, the upwardly extending lateral flanges 20 of which lap the insides of the cover flanges 16 and are secured thereto by screws 22. The base member is configured with a forwardly projecting staple lifter tongue 24. The forward edge of the tongue is beveled to facilitate slipping it under the bridge portion 26 (FIG. 6) of a staple extending between the spaced legs 28 of the staple. The width of the tongue 24 may be varied between models of the tool for optimum performance with staples of various sizes. The staples may vary in bridge width and leg length, depending upon the application. For example, staples for securing roofing to a roof sub-structure typically have a bridge ranging from ⅜ths inch (1 cm) to 1 inch (2.5 cm) and legs arranging in length from ⅝ths inch (1.5 cm) to 2 inches (5 cm).

A clamping member 30 of right angular configuration is secured pivotally intermediate its ends to the upper side of the base member, as by pivot bolt 32. The nut 32' is secured in a loosened condition to allow the clamping member to move vertically slightly, to effect clearing of debris from under it. One section of the clamping member extends forwardly, in the same direction as tongue 24, and forms a clamping arm 34. It preferably is narrower in width than the tongue to serve a secondary function of a narrowed tongue for use with correspondingly narrow staples.

The primary function of the clamping arm is to clamp a leg of a staple between it and the confronting edge of tongue 24, when the staple resists extraction from the wooden anchor material of a roof or other structure.

The drive section 36 of the clamping member 30 terminates at its outer end in an upwardly offset reverse bend portion 38. This portion is provided with an opening 40 for pivotal reception of one end of an elongated link member 42. The opposite end of the link member is connected pivotally to one offset leg 44 of a right angled plate 46 which is mounted pivotally intermediate its ends, by bolt 48, to a bracket 50 projecting downward from the base member 18. The opposite, angularly offset leg 52 of the plate 46 is secured to one end of an elongated hand lever 54 which extends under and parallel to the rearward hand grip portion 10, for manipulation by the fingers of a hand grasping the handle portion.

Figure 3:
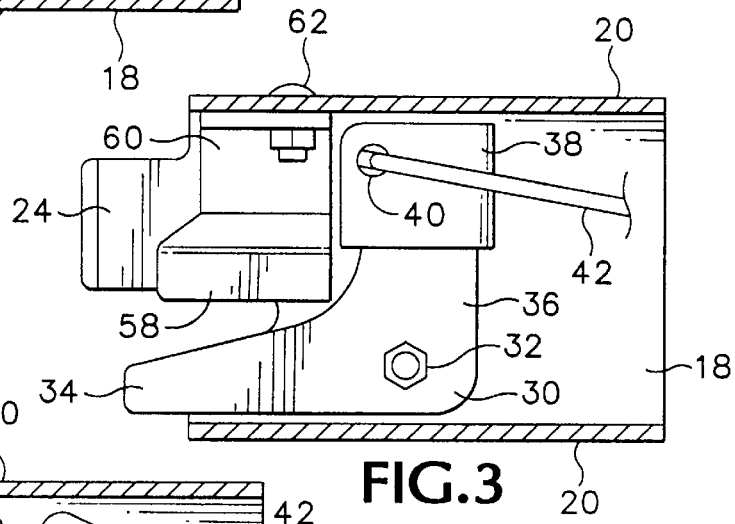
FIG. 3 is a horizontal sectional view taken on the line 3—3 in FIG. 2, showing the clamping arm in retracted position.
Figure 4:
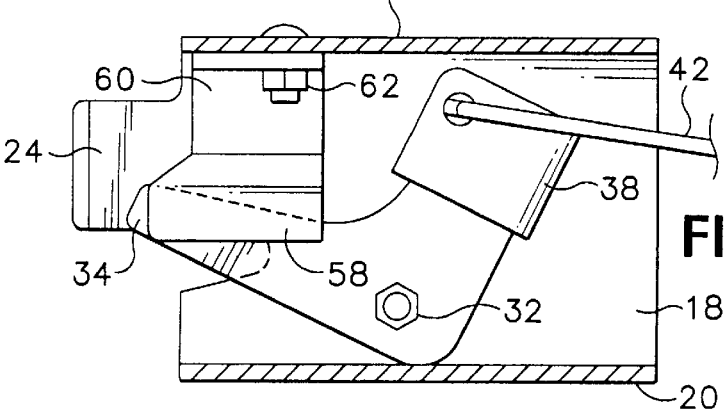
FIG. 4 is a horizontal sectional view similar to FIG. 3 but showing the clamping arm in staple-clamping position.
Figure 5:
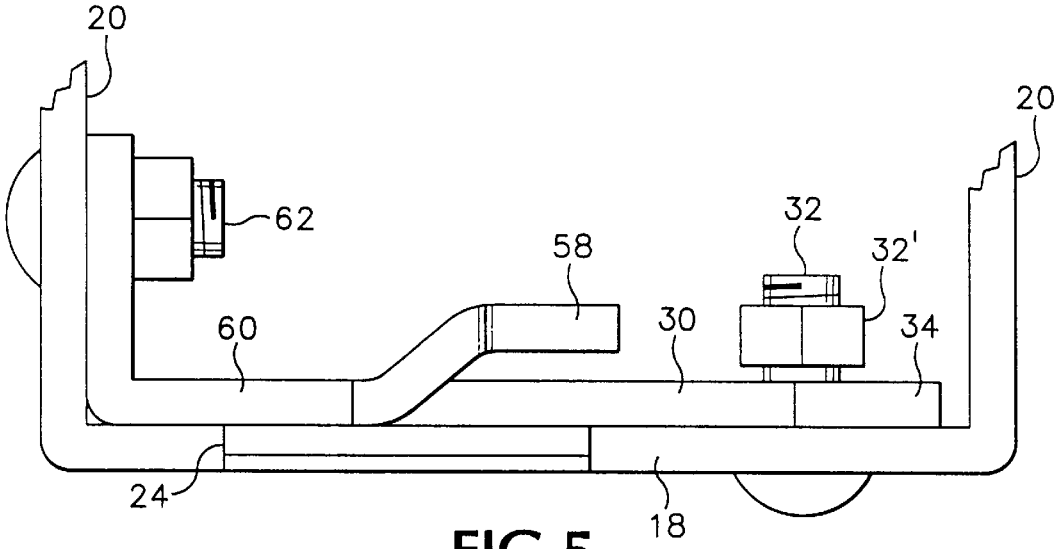
FIG. 5 is a fragmentary diagrammatic front elevation of the tool of FIG. 1 showing the clamping arm in retracted position.
Figure 7:
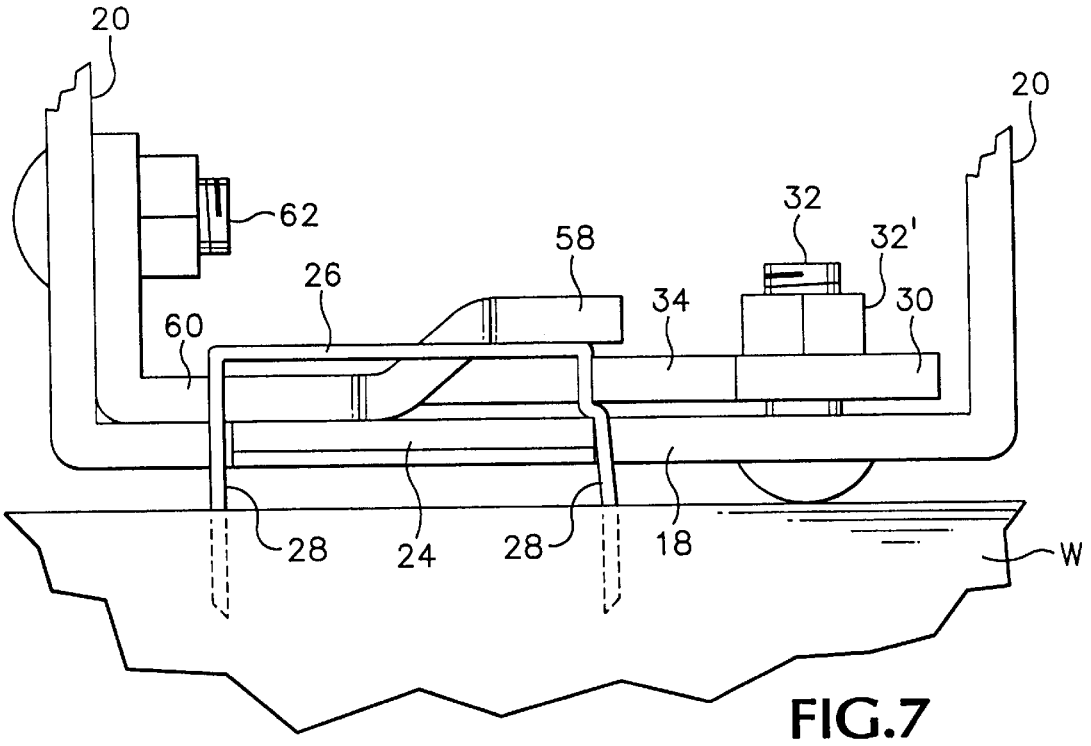
FIG. 7 is a fragmentary diagrammatic front elevation similar to FIG. 6 but with the clamping arm engaging one leg of a staple the bridge of which is elevated above the tongue, to clamp the staple leg to the tool.

By virtue of the interconnecting link member 42, pivoting of the hand lever 54 effects pivoting of the clamp member 30 and movement of the clamping arm 34 toward and away from the tongue 24. When moved toward the tongue the clamping arm is capable of clamping a staple leg 28 between it and the confronting edge of the tongue 24, when the staple bridge 26 is elevated a short distance above the tongue, as illustrated in FIG. 7. A coil spring 56 interconnects the leg 44 and base member flange 20 to urge the clamping arm 34 to retracted position (FIG. 3).

Figure 8:
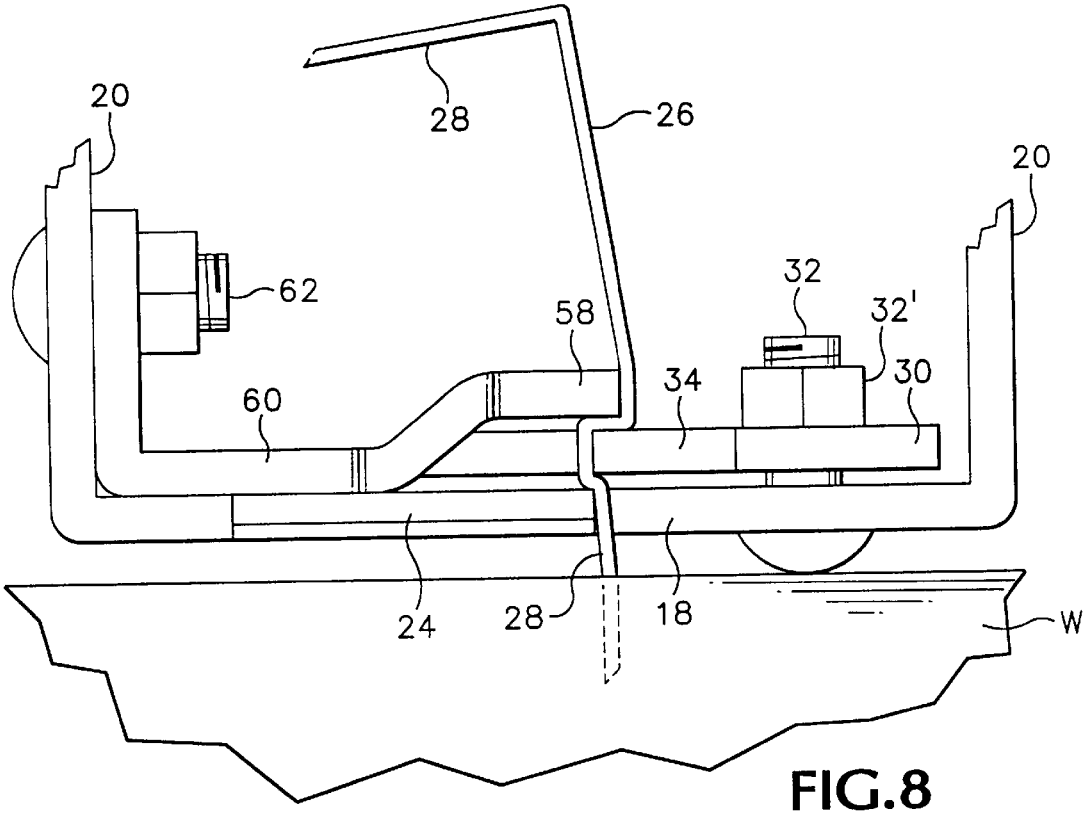
FIG. 8 is a fragmentary diagrammatic front elevation similar to FIG. 7 but showing the clamping arm in operative position forming with the crimping arm a U-shaped crimp on one leg of a staple that is shown still anchored in a wooden roof structure with the opposite leg of the staple fully extracted from a wooden structure and projecting upward from the still anchored staple leg.

In some instances a staple may be so anchored in the wooden structure that one leg 28 resists extraction, while the other leg is removed, or the staple is broken. The portion of the anchored leg that projects above the wood serves to provide a crimp by which to lock the leg securely to the tool and insure its extraction from the wood by leveraging the handle. For this purpose, a crimping bar 58 is formed as an offset end portion of a right angled plate 60 secured to the base member 18 by bolt 62. The crimping bar is offset upwardly from the underlying base member 18 sufficiently to receive the clamping arm 34 between them. As shown in FIG. 8, this results in the staple leg being bent to U-shape, forming a positive, non-slip lock with the clamping arm to insure full extraction of the staple leg from the wood anchor.

It is to be noted in FIG. 8 that the edge of the fixed crimping bar 58, which is abutted by the upstanding staple leg, extends laterally beyond the cooperating edge of the fixed base member 18. Thus, as the clamping arm 34 moves toward said edges, it moves the staple leg against the edge of bar 58 before the leg abuts base 18. The staple leg thereby is bent first at the edge of bar 58 and then at the edge of base 18. This arrangement prevents the clamping arm 34 from sliding upward toward and beyond the edge of bar 58, thereby insuring the formation of the U-shaped bend in the staple leg.

In operation, the tool is used to remove the staples that remain in the wood after the old roofing material has been removed, preparatory to installing new roofing. Because the roofing material secured by the staples have been removed, the bridges 26 of the remaining staples are elevated above the roof surface. The tongue 24 thus may be slipped under the bridge of a staple, whereupon the rearward hand grip portion 10 of the handle then is pivoted about the rear end of the base member 18, as a fulcrum, to leverage the staple out of the wood.

It is a frequent occurrence that a staple resists extraction from the wood. In such a case, the hand lever 54 is pivoted upward toward the overlying handle 10 to move the clamping arm 34 toward the tongue 24 until the staple leg is clamped between them (FIG. 7). The handle 10 once again is pivoted to leverage the staple leg out of the wood.

In the event only one leg of the staple is pulled free of the wood W, as illustrated in FIG. 8, the freed leg and bridge of the staple are extended vertically upward alongside the confronting end of the crimping bar 58. The clamping arm 34 then is moved to enter the space between the crimping bar and tongue 24 to form the U-shaped bend discussed above and enable extracting the anchored leg from the wood.

When extra long staples are used, it is convenient to form the U-shaped crimp at spaced intervals along the staple leg to effect its extraction in stages.

It will be apparent to those skilled in the art that various changes may be made in the size, shape, type, number and arrangement of parts described hereinbefore, without departing from the spirit of this invention and the scope of the appended claims.

We claim:

1. A staple removal tool for U-shaped staples having a bridge portion extending between spaced legs, the tool comprising:

a) an elongated handle member having front and rear end portions, b) a base member secured to the front end portion of the handle member and having a forwardly extending staple lifter tongue configured for reception under the bridge portion of a staple, and c) a staple clamping arm mounted on the base member for movement laterally toward and away from the staple lifter tongue for clamping a leg of a staple releasably to the base member.

2. The staple removal tool of claim 1 including a crimping bar secured to the base member and spaced therefrom to receive the clamping arm therebetween, to form a U-shape crimp in a staple leg.

3. The staple removal tool of claim 1 including a hand lever mounted pivotally on the handle member, and link means interengaging the hand lever and clamping arm for moving the clamping arm laterally.

4. The staple removal tool of claim 3 including resilient means interengaging the hand lever and base member for urging the clamping arm laterally away from the staple lifter tongue.

5. The staple removal tool of claim 1 wherein the clamping arm extends forwardly in the direction of and spaced laterally from the staple lifter tongue to form a second staple lifter tongue.

6. The staple removal tool of claim 1 including:

a) a crimping bar secured to the base member and spaced therefrom to receive the clamping arm therebetween to form a U-shape crimp in a staple leg, b) a hand lever mounted pivotally on the handle member, c) link means interengaging the hand lever and clamping bar for moving the clamping bar, and d) resilient means interengaging the hand lever and base member for urging the clamping bar away from the staple lifter tongue.

* * * * *